United States Patent [19]

Bullock et al.

[11] Patent Number: 4,754,524

[45] Date of Patent: Jul. 5, 1988

[54] DOOR WITH PIVOT HINGE

[75] Inventors: Robert E. Bullock, Malvern; Raymond A. Johnson, Hot Springs, both of Ark.

[73] Assignee: The Chamberlain Group, Inc., Elmhurst, Ill.

[21] Appl. No.: 915,705

[22] Filed: Oct. 6, 1986

[51] Int. Cl.[4] ..... E05D 7/08

[52] U.S. Cl. ..... 16/273; 16/378

[58] Field of Search ..... 16/223, 273, 378, 379, 16/231, 232, 379, 380; 49/382, 400, 397, 398

[56] References Cited

U.S. PATENT DOCUMENTS

| | | | |
|---|---|---|---|
| 595,332 | 12/1897 | McIntosh . | |
| 1,730,001 | 10/1929 | Fisher . | |
| 1,750,747 | 3/1930 | Domscheit . | |
| 2,296,813 | 9/1942 | Dunham . | |
| 3,025,574 | 3/1962 | Finkel . | |
| 3,029,747 | 4/1962 | Shaver . | |
| 3,300,897 | 1/1967 | Wikkerink . | |
| 3,331,159 | 7/1967 | Cooke et al. . | |
| 3,430,386 | 3/1969 | Sandin | 49/382 |
| 3,475,863 | 11/1969 | Varlonga . | |
| 3,592,257 | 7/1971 | Matyas | 16/379 |
| 3,604,154 | 9/1971 | Curran | 16/379 |
| 4,041,644 | 8/1977 | Alcanzare . | |

FOREIGN PATENT DOCUMENTS

| | | | |
|---|---|---|---|
| 1234823 | 10/1960 | France | 16/273 |
| 562718 | 7/1944 | United Kingdom | 49/400 |

*Primary Examiner*—Fred Silverberg

*Attorney, Agent, or Firm*—Hill, Van Santen, Steadman & Simpson

[57] ABSTRACT

A door with a pivot hinge which can be mounted to a frame with a pair of L-shaped brackets and which includes an insert comprising a nylon bushing that is mounted into the edge of the door and is adapted to receive a pivot pin mounted on the L-shape bracket. The door is mounted to a hinge Z-bar which is provided with an arcuate portion so as to allow the door to pivot and the door can be swung from either side by inserting the bushing and pivot pins on either side.

3 Claims, 3 Drawing Sheets

FIG. 3
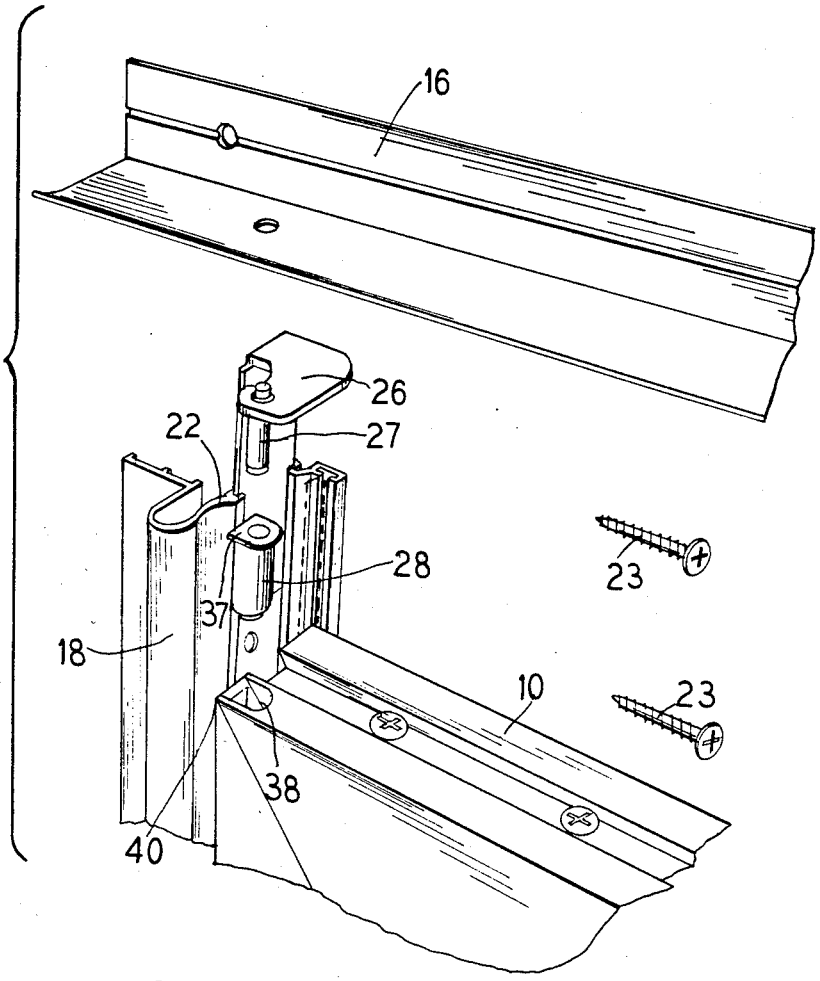
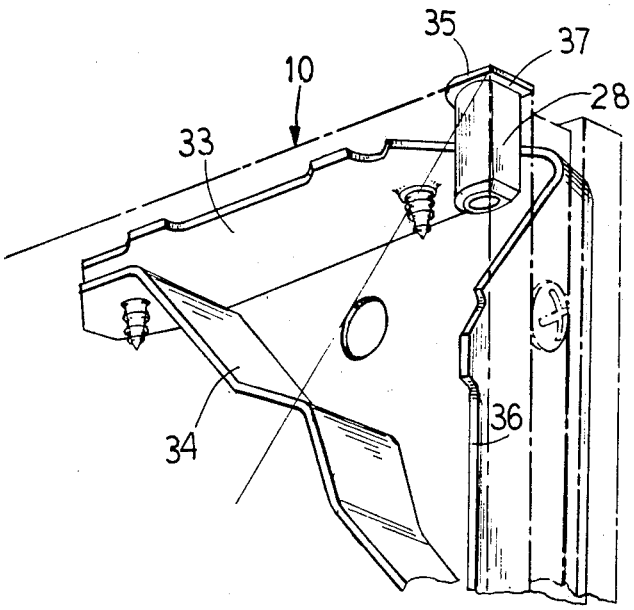
FIG. 4

DOOR WITH PIVOT HINGE

BACKGROUND OF THE INVENTION

1. Field of the Invention

This invention relates in general to a door and in particular to a novel door with pin pivots which can be swung from either side.

2. Description of the Prior Art

U. S. Pat. No. 3,331,159 discloses a swinging door construction.

SUMMARY OF THE INVENTION

The present invention relates to a novel mounting for a door which can be swung from either side wherein a hinge bar is modified with an arcuate portion and a pair of L-shaped brackets are attached to the bar at opposite ends of the door and are provided with pivot pins which are receivable in bushings that are inserted into opposite ends of the door. The bushings can be mounted to the door on either side thereof to allow the door to be hung from either side of the door opening and, thus, allow the door to be swung from either side.

It is an object of the present invention to provide an improved door mounting wherein a bushing is inserted into the top edge of the door and a second bushing is inserted into the bottom edge of the door and L-shaped brackets with pivot pins are hinged to a Z-bar so as to pivotably support the door.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 3 is an exploded view illustrating one end of the pivot arrangement for the door;

FIG. 4 is a cut-away view of the corner portion of the door;

DESCRIPTION OF THE PREFERRED EMBODIMENTS

Figure 1:
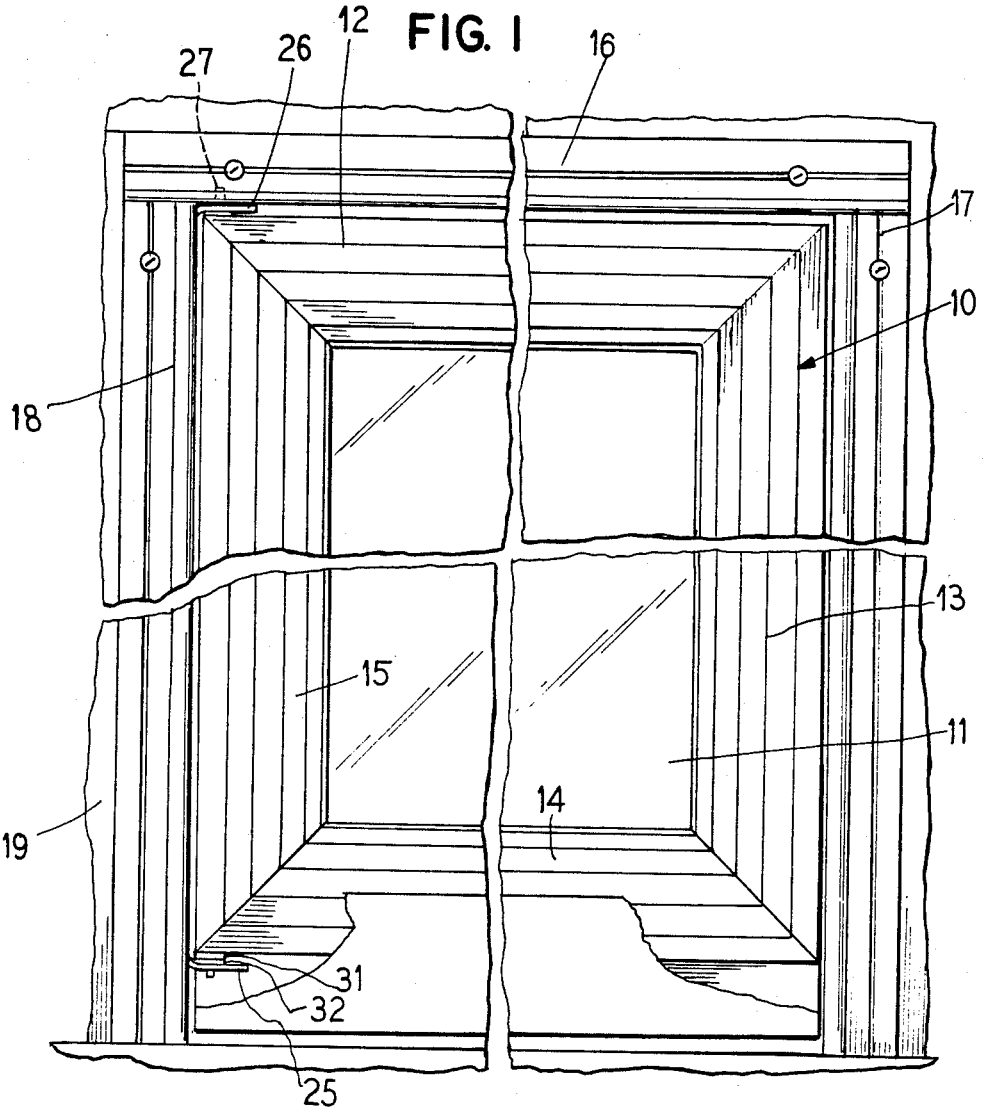
FIG. 1 is a front plan view of the door of the invention.

FIG. 1 illustrates the novel door 10 of the invention which includes a glass pane mounted in top frame member 12, a bottom frame member 14 and side frame members 13 and 15 which are connected to the top and bottom frame members as shown. The door is mounted in an opening formed by a side bar member 17 and a second side bar member 18 and a bar head member 16. As shown in FIGS. 1-4, L-shaped brackets 25 and 26 are respectively mounted to the bottom and to the side frame member 18 to which the door is to be pivoted. As shown in FIG. 3, the L-shaped bracket 26 and the L-shaped bracket 25 are connected by screws 23 to the frame 19 and the screws 23 also pass through the hinge bar member 18 to attach it to the frame. The upper bracket 26 is also attached to the frame with suitable screws and the upper bracket has a pivot pin 27 and the lower bracket 25 has a pivot pin 29. A nylon washer 32 may be mounted about the pivot pin 29 between the door and the bracket 25. Nylon bushings 28 are press fitted into openings 38 in the upper and lower edges of the door 10 as shown, for example in FIGS. 3 and 4 and it is to be noted as shown in FIG. 4 that the door 10 is generally hollow and has frame members 33, 34 and 36 mounted therein and the bushing 28 has a top 35 and a flat side 37 and a central opening for the pivot pin.

Figure 2:
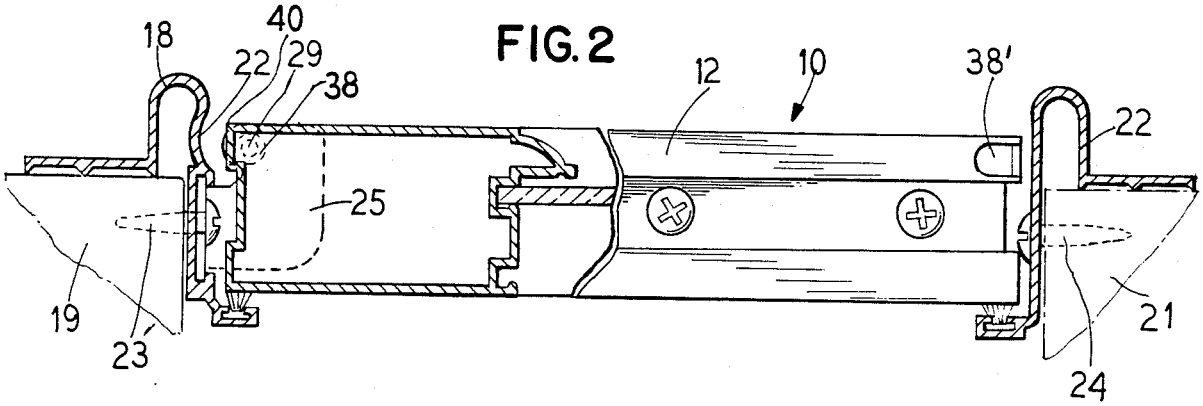
FIG. 2 is a partially cut-away top view of the door.

The side bar member 18 to which the door is to be hinged is provided with a curved or arcuate portion 22 as illustrated in FIG. 3 so as to allow the outer corner 40 of the door to pivot without binding. This is illustrated in FIGS. 2 and 3.

If, for example, it is desired to hinge the door from the opposite side to that illustrated in FIG. 1, then the bar 18 is mounted to the right of the door rather than to the left of the door and the bar member 17 is mounted to the left of the door relative to FIG. 1. This allows the door to be hinged from either side as desired. For this purpose, openings 38' are also formed in the top and bottom of the door as illustrated in FIG. 2 and suitable bushings 28 would be mounted in the top and bottom of the door to allow it to be hinged from the other side relative to that illustrated in FIGS. 1, 2 and 3.

Figure 5:
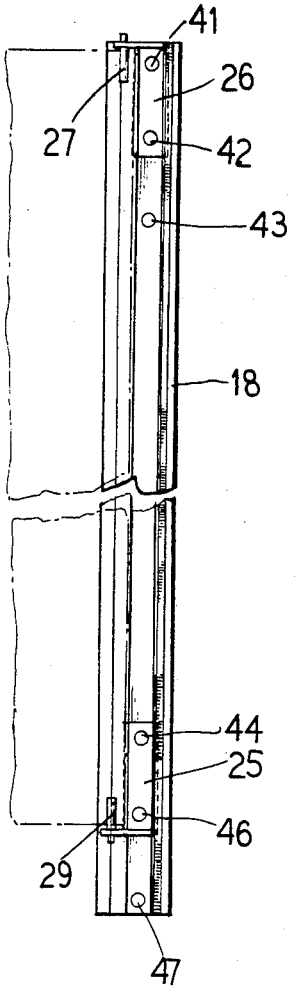
FIG. 5 is a side view illustrating the door mounted for pivoting in a first direction.
Figure 6:
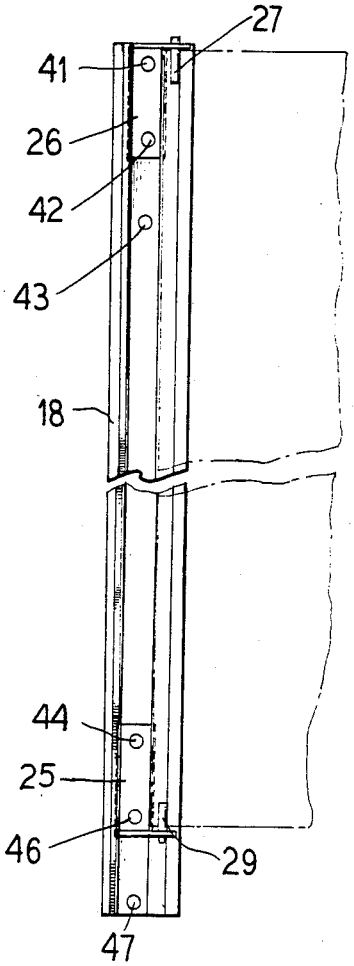
FIG. 6 is a side view illustrating the door mounted for pivoting in a second direction.

FIG. 5 illustrates an L-shape bracket 26 attached to the upper end of member 18 and the lower bracket 25 attached to the lower end of the member 18. FIG. 6 illustrates the door hung from the opposite side. It is also to be noted that the side members are provided with three openings 41, 42, 43 at the top edges thereof and three openings 44, 46 and 47 at the bottom edges thereof to allow the brackets 26 and 25 to be adjusted vertically relative to each other and the member 18 and the two upper or the two lower openings can be used and suitable set screws are used to lock the L-shaped members 26 and 25 to the member 18. Member 18 can also be cut to length if it is too long so as to suitably fit the door opening.

Figure 7:
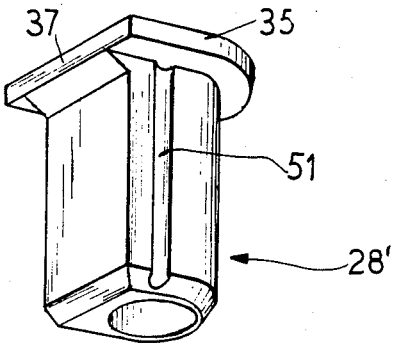
FIG. 7 illustrates a modification of the bushing.

FIG. 7 illustrates a modification of the bushing 28 which is formed with groove 51 on either side or on one side the bushing 28' has an upper rim 35 with a straight back edge 37 and may be made of nylon, for example. The grooves 51 align with mating extensions in the openings 38.

It is seen that the novel door of this invention may be mounted so that it can be swung from either direction and can be adjusted to doors of different sizes.

Although the invention has been described with respect to preferred embodiments, it is not to be so limited as changes and modifications can be made which are within the full intended scope of the invention as defined by the appended claims.

We claim as our invention:

1. The combination of a means for mounting and a pivoting door comprising a side frame member, a pair of L-shaped brackets attached to said side frame and spaced apart from each other and each bracket having vertical extending pivot pins, a door with a front and rear and formed with first and second openings in its upper and lower edges adjacent one side and said first and second openings extend a substantial distance into said door and first and second plastic bushings formed with openings for said pivot pins and receivable in said first and second openings in the upper and lower edges of said door, wherein said first and second bushings are formed of nylon, wherein said side frame member is formed of extruded metal, wherein said first and second bushings are mounted nearer the front than the rear of the door, and wherein said side frame has a portion which extends beyond the front of said door and said portion is concave so that corner of the door can pivot without engaging said side frame.

2. A combination according to claim 1 wherein said first and second bushings are formed with longitudinal extending grooves.

3. A combination according to claim 3 wherein third and fourth openings are formed in the upper and lower edges of said door near a second side so that the door can be pivoted from either side.

* * * * *